US010409202B2

(12) United States Patent
Nakamura et al.

(10) Patent No.: US 10,409,202 B2
(45) Date of Patent: Sep. 10, 2019

(54) INTERMEDIATE TRANSFER UNIT HAVING A DRIVING ROLLER CLEANING DEVICE AND AN IMAGE FORMING APPARATUS INCLUDING THE SAME

(71) Applicant: KYOCERA Document Solutions Inc., Osaka (JP)

(72) Inventors: Satoru Nakamura, Osaka (JP); Ayaka Kondo, Osaka (JP); Teppei Shibuya, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/991,112

(22) Filed: May 29, 2018

(65) Prior Publication Data

US 2018/0348675 A1 Dec. 6, 2018

(30) Foreign Application Priority Data

May 30, 2017 (JP) ..... 2017-107176

(51) Int. Cl.
*G03G 15/16* (2006.01)
*G03G 21/00* (2006.01)

(52) U.S. Cl.
CPC ..... *G03G 15/1615* (2013.01); *G03G 21/0029* (2013.01); *G03G 15/161* (2013.01); *G03G 2221/1657* (2013.01)

(58) Field of Classification Search
CPC ..... G03G 15/161; G03G 21/0029; G03G 21/0011; G03G 21/007
See application file for complete search history.

(56) References Cited

U.S. PATENT DOCUMENTS 4,937,632 A * 6/1990 Kamidaira ..... G03G 21/0029 399/102
7,809,305 B2 * 10/2010 Takuwa ..... G03G 15/161 399/302

FOREIGN PATENT DOCUMENTS

JP 2001-022187 1/2001

* cited by examiner

*Primary Examiner* — Walter L Lindsay, Jr.
*Assistant Examiner* — Arlene Heredia
(74) *Attorney, Agent, or Firm* — Wenderoth, Lind & Ponack, L.L.P.

(57) ABSTRACT

An intermediate transfer unit includes an endless intermediate transfer belt to which a toner image is primarily transferred from an image carrying member, a driving roller that conveys the intermediate transfer belt with the primarily transferred toner image to a secondary transfer position for a sheet material, and a cleaning device which cleans a peripheral surface of the driving roller around which the intermediate transfer belt is wound.

4 Claims, 10 Drawing Sheets

1
2
3
5
6
7
8
9
11
12
13
15
16
17
18
19
20
21
22
23
24
25
27
28
31
32
33
34
80
A
B
C
V

INTERMEDIATE TRANSFER UNIT HAVING A DRIVING ROLLER CLEANING DEVICE AND AN IMAGE FORMING APPARATUS INCLUDING THE SAME

CROSS-REFERENCE TO RELATED APPLICATION

This application is based upon and claims the benefit of priority from Japanese Patent Application No. 2017-107176 filed on May 30, 2017, the entire contents of which are incorporated herein by reference.

BACKGROUND

The technology of the present disclosure relates to an intermediate transfer unit and an image forming apparatus including the same.

An intermediate transfer unit includes an endless intermediate transfer belt to which a toner image is primarily transferred from an image carrying member, and a driving roller that rotates the intermediate transfer belt, and allows the toner image primarily transferred to the intermediate transfer belt to be positioned at a secondary transfer position of a sheet material by rotational driving of the driving roller.

An image forming apparatus transfers, to the sheet material, the toner image formed on the image carrying member via the intermediate transfer unit.

In this type of image forming apparatus, toner floats in the apparatus during its operation or immediately after its operation. Since image failure easily occurs when the floating toner is attached to each part of the intermediate transfer unit, a cleaning blade is provided to the image forming apparatus to clean an outer surface of the intermediate transfer belt in the related art.

SUMMARY

An intermediate transfer unit according to one aspect of the present disclosure includes an endless intermediate transfer belt and a driving roller. A toner image is primarily transferred to the intermediate transfer belt from an image carrying member. The driving roller rotates the intermediate transfer belt. The intermediate transfer unit allows the toner image primarily transferred to the intermediate transfer belt to be positioned at a secondary transfer position of a sheet material by rotational driving of the driving roller. The intermediate transfer unit further includes a cleaning device. The cleaning device cleans a peripheral surface of the driving roller around which the intermediate transfer belt is wound.

An image forming apparatus according to another aspect of the present disclosure includes the aforementioned intermediate transfer unit. In the image forming apparatus, the toner image formed on the image carrying member is transferred to the sheet material via the intermediate transfer unit.

DETAILED DESCRIPTION

Hereinafter, an example of an embodiment will be described in detail on the basis of the drawings. It is noted that the technology of the present disclosure is not limited to the following embodiments.

Figure 1:
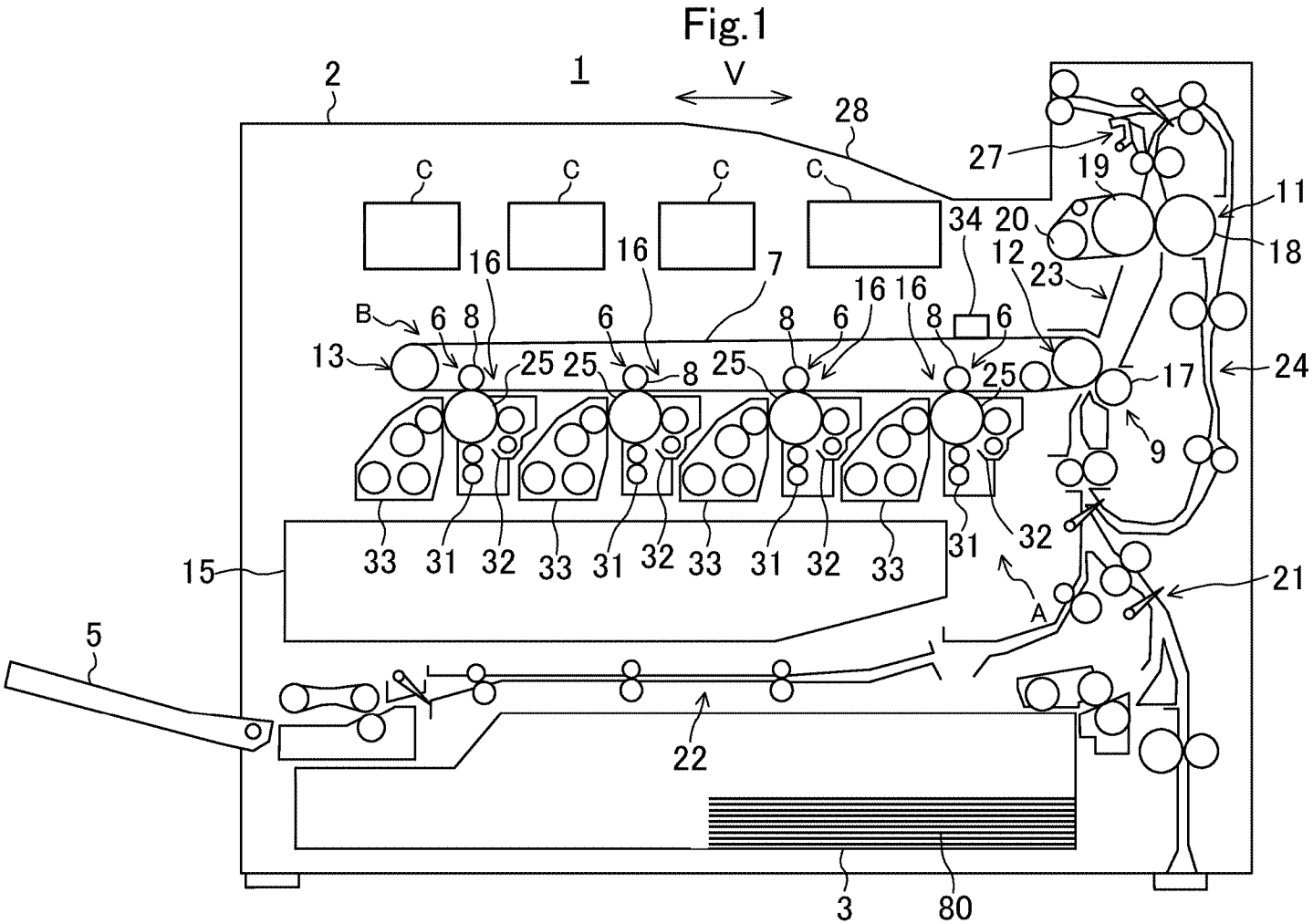
FIG. 1 is a schematic diagram illustrating an overall configuration of an image forming apparatus.

FIG. 1 is a schematic diagram illustrating an overall configuration of an image forming apparatus 1. The image forming apparatus 1, for example, is a tandem type color printer and includes a development unit A, an intermediate transfer unit B disposed above the development unit A, and a plurality of (four) toner containers C disposed above the intermediate transfer unit B. Furthermore, the image forming apparatus 1 also includes a primary transfer unit 6, a secondary transfer unit 9, a fixing unit 11, and an optical scanning device 15. The development unit A has a plurality of (four) image forming units 16 disposed above the optical scanning device 15. The intermediate transfer unit B has an endless intermediate transfer belt 7, wherein the intermediate transfer belt 7 is disposed above the four image forming units 16 along an arrangement direction of the image forming units 16.

At an internal lower part of an apparatus body 2 of the image forming apparatus 1, a sheet feeding cassette 3 is disposed. The sheet feeding cassette 3 receives non-printed sheets 80 (corresponding to sheet materials) stacked therein. At a lateral side of the sheet feeding cassette 3, a first sheet conveying unit 21 is provided. The first sheet conveying unit 21 receives the sheets 80 sent from the sheet feeding cassette 3, and conveys the sheets 80 to the secondary transfer unit 9 disposed above.

At a lateral side of the sheet feeding cassette 3, which is opposite to the first sheet conveying unit 21, a manual sheet feeding unit 5 is provided. Between the manual sheet feeding unit 5 and the first sheet conveying unit 21, a second sheet conveying unit 22 is provided. The second sheet conveying unit 22 receives the sheets 80 sent from the manual sheet feeding unit 5, and conveys the sheets 80 to the first sheet conveying unit 21.

The optical scanning device 15 is disposed above the second sheet conveying unit 22, and irradiates laser light to the image forming units 16 on the basis of image data received in the image forming apparatus 1. The intermediate transfer belt 7 is wound around a driving roller 12 and a driven roller 13, and is rotationally driven by a driving device (not illustrated). At a left upper part of the driving roller 12, an intermediate transfer belt cleaning device 34 is disposed to clean a surface (an outer surface) of the intermediate transfer belt 7.

The intermediate transfer belt 7 is configured to abut outer peripheral surfaces of a plurality of photosensitive drums 25 (corresponding to image carrying members) and to allow toner images to be primarily transferred from the outer peripheral surfaces of the plurality of photosensitive drums 25.

The four image forming units 16 are disposed in a row along the intermediate transfer belt 7, and form yellow, magenta, cyan, and black toner images, respectively. Each of the image forming units 16 has the photosensitive drum 25, and a charging device 31, a developing part 33, and a cleansing device 32, which are disposed around the photosensitive drum 25.

The charging device 31 charges the surface of the photosensitive drum 25. On the photosensitive drum 25 charged by the charging device 31, an electrostatic latent image is formed by the laser light irradiated from the optical scanning device 15. The developing part 33 develops the electrostatic latent image, thereby forming a toner image on the surface of the photosensitive drum 25.

The primary transfer units 6 are disposed above the image forming units 16, respectively. The primary transfer units 6 has a primary transfer roller 8 that primarily transfers the toner image formed on the photosensitive drum 25 by the image forming unit 16 to the surface of the intermediate transfer belt 7.

Together with the rotational driving of the intermediate transfer belt 7, the toner image on each photosensitive drum 25 is primarily transferred to the intermediate transfer belt at a predetermined timing by a voltage having a polarity opposite to a charging polarity of toner applied to the primary transfer roller 8. In this way, on the surface of the intermediate transfer belt 7, a color toner image, in which toner images of four colors (yellow, magenta, cyan, and black) are superposed on one another, is formed. Furthermore, the surfaces of the photosensitive drum 25, from which the toner images have been primarily transferred to the intermediate transfer belt 7, are cleaned by the cleansing devices 32.

The secondary transfer unit 9 has a secondary transfer roller 17 disposed at a lateral side of the intermediate transfer belt 7. The secondary transfer unit 9 is configured to secondarily transfer the toner images on the intermediate transfer belt 7 to the sheet 80 sent from the first sheet conveying unit 21 at a voltage having a polarity opposite to a charging polarity of toner applied to the secondary transfer roller 17.

The fixing unit 11 is provided above the secondary transfer unit 9. Between the secondary transfer unit 9 and the fixing unit 11, a third sheet conveying unit 23 is formed to convey the sheet 80 with the secondarily transferred toner images to the fixing unit 11. The fixing unit 11 includes a pressure roller 18, a fixing roller 19, and a heating roller 20. Furthermore, the fixing unit 11 is configured to heat and press the sheet 80 conveyed from the third sheet conveying unit 23, thereby fixing the toner images to the sheet 80.

A branch part 27 is provided above the fixing unit 11. The sheet 80 discharged from the fixing unit 11 is discharged from the branch part 27 to a sheet discharge unit 28 formed at an upper part of the image forming apparatus 1 when duplex printing is not performed. When the duplex printing is performed, the sheet 80 is conveyed again from the branch part to the secondary transfer unit 9 via a fourth sheet conveying unit 24.

[Detailed Structure of Intermediate Transfer Unit B]

As illustrated in FIG. 1 to FIG. 4, the intermediate transfer unit B includes a rectangular device frame 50 long in the right and left direction V of the image forming apparatus 1 in a plan view. The device frame 50 is provided with a first sidewall 51 and a second sidewall 52 spaced apart from each other in the front and rear direction W of the image forming apparatus 1, and is further provided with a connection wall 78 (see FIG. 6B) that connects the first sidewall 51 and the second sidewall 52 to each other. The first sidewall 51, the second sidewall 52, and the connection wall 78 are respectively provided with a lattice-like reinforcing part 53.

Figure 2:
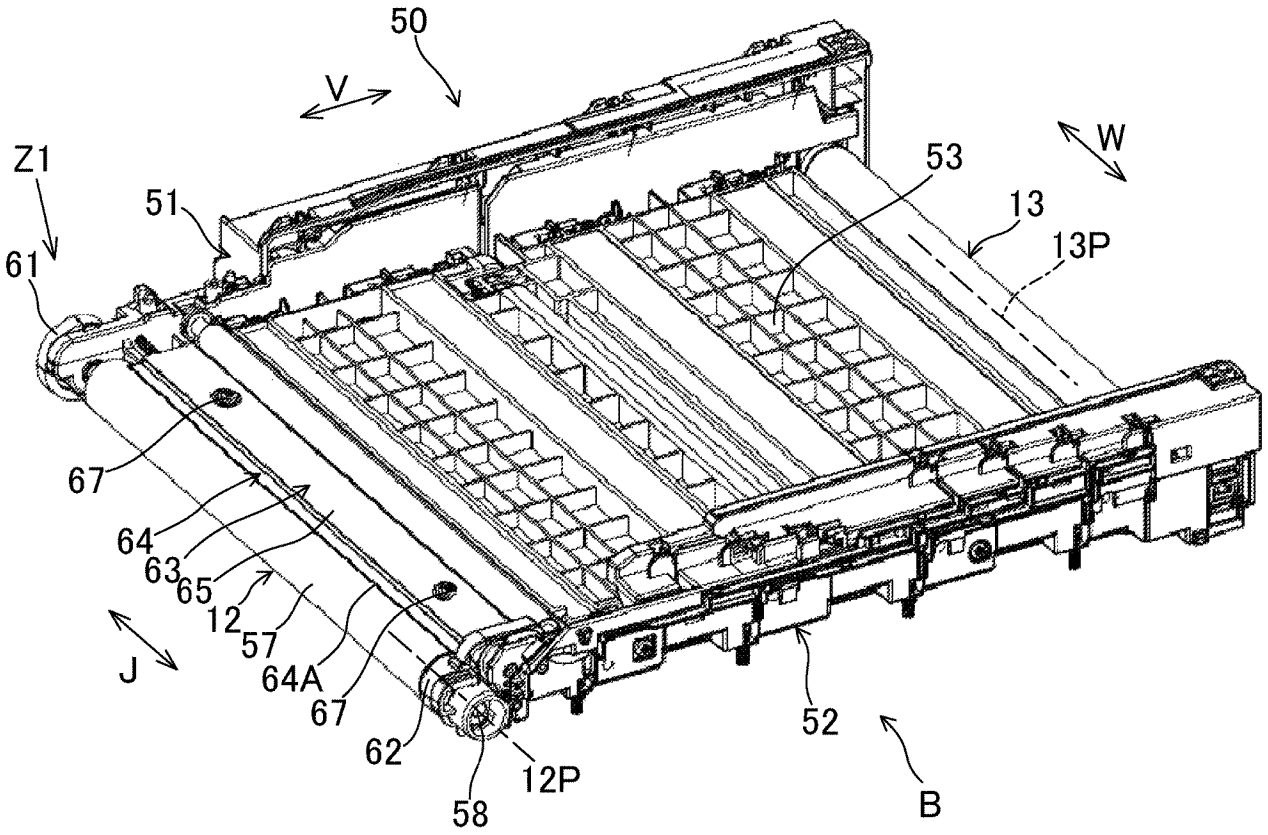
FIG. 2 is a perspective view when an intermediate transfer unit is viewed from an obliquely upper rear side (the intermediate transfer unit is omitted).
Figure 4:
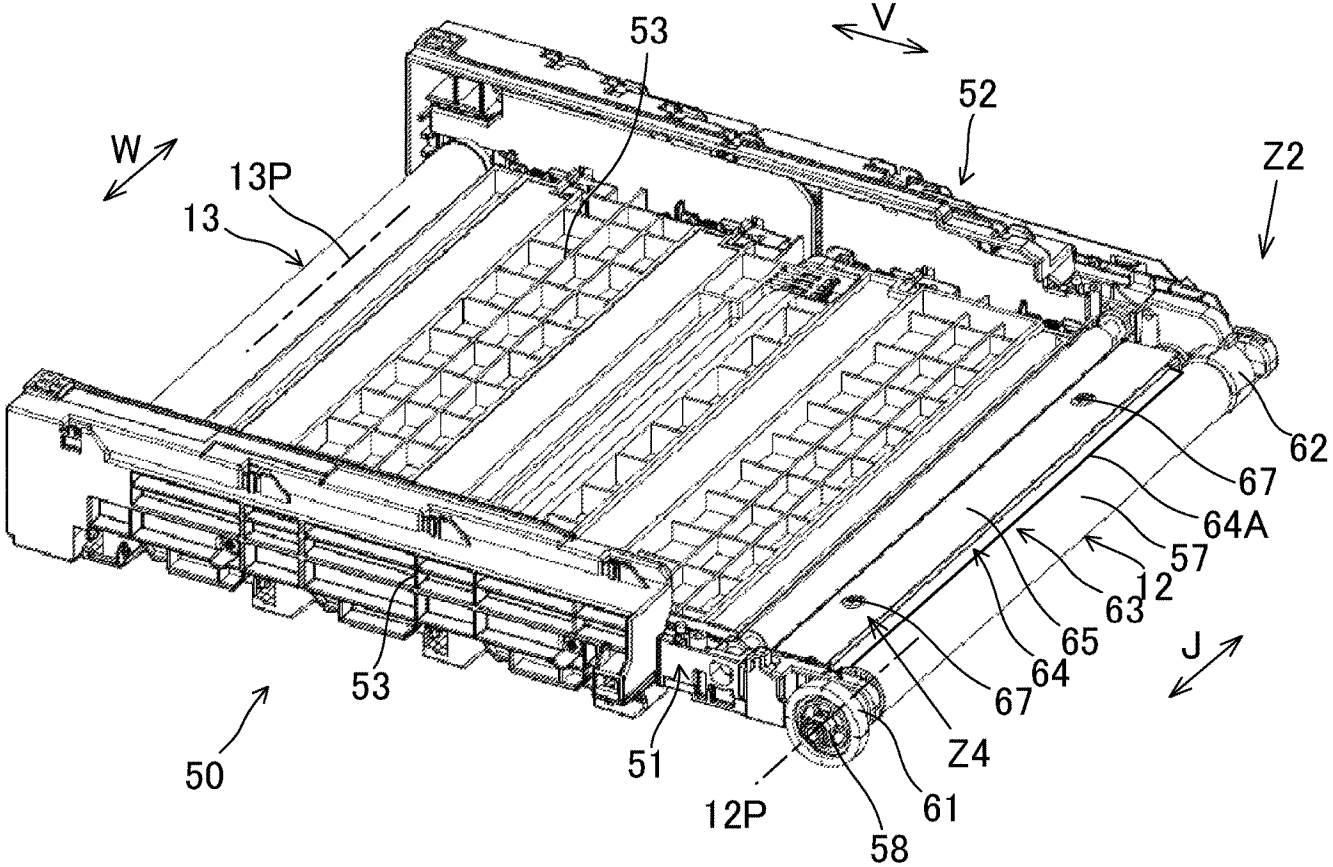
FIG. 4 is a perspective view when an intermediate transfer unit is viewed from an obliquely upper front side (the intermediate transfer unit is omitted).

Furthermore, at one end part of the first sidewall 51 and one end part of the second sidewall 52 in the longitudinal direction, the driving roller 12 is supported around a roller shaft center (shaft core) 12P so as to freely rotate, and at the other end part of the first sidewall 51 and the other end part of the second sidewall 52, the driven roller 13 is supported around a roller shaft center (shaft core) 13P so as to freely rotate. Both the driving roller 12 and the driven roller 13 are formed thin and long in the front and rear direction W of the image forming apparatus 1, and the intermediate transfer belt 7 (see FIG. 1) is wound around the driving roller 12 and the driven roller 13 as described above. In FIG. 2, FIG. 4 and the like, the intermediate transfer belt 7 is omitted.

The driving roller 12 includes a roller body 57, and a pair of roller shafts 58 individually protruding from the center parts of both end surfaces of the roller body 57 outward in a roller shaft center direction J. The roller shaft center direction J and the front and rear direction W of the image forming apparatus 1 are the same direction. The roller shafts 58 have a diameter smaller than that of the roller body 57, and are inserted into support holes, which are formed at one end part of the first sidewall 51 and one end part of the second sidewall 52 so as to freely rotate.

A first gear 61 is externally fitted to one roller shaft 58 of the driving roller 12 so as to integrally freely rotate, and a second gear 62 is externally fitted to the other roller shaft 58 so as to integrally freely rotate. The first gear 61 is engaged with a gear of an electric motor (not illustrated) side, and the second gear 62 is engaged with a gear of the secondary transfer roller 17 (see FIG. 1) side. When the electric motor is driven and rotated, the driving roller 12 and the driven roller 13 are respectively rotated around the roller axis centers 12P and 13P, so that the intermediate transfer belt 7 is rotated in a counterclockwise direction in FIG. 1 and thus the secondary transfer roller 17 is rotated. The toner image primarily transferred to the intermediate transfer belt 7 is positioned at a secondary transfer position (a position for secondarily transferring the toner image to the sheet 80) of the sheet 80 by the rotational driving of the driving roller 12.

[Structure of Cleaning Device 63]

As illustrated in FIG. 2 to FIG. 5, the intermediate transfer unit B is provided with the cleaning device 63 that cleans a peripheral surface 57M (see FIG. 9) of the roller body 57 of the driving roller 12. The cleaning device 63 has a scraper 64 (corresponding to a cleaning unit) abutting the peripheral surface 57M of the roller body 57, and a scraper holding plate 65 that is placed on the connection wall 78 (see FIG. 9) of the device frame 50 and holds the scraper 64 from an opposite side of the roller body 57. The scraper 64 is made of resin and the scraper holding plate 65 is made of metal. The scraper 64 and the scraper holding plate 65 may be formed using materials other than resin and metal.

Figure 6A:
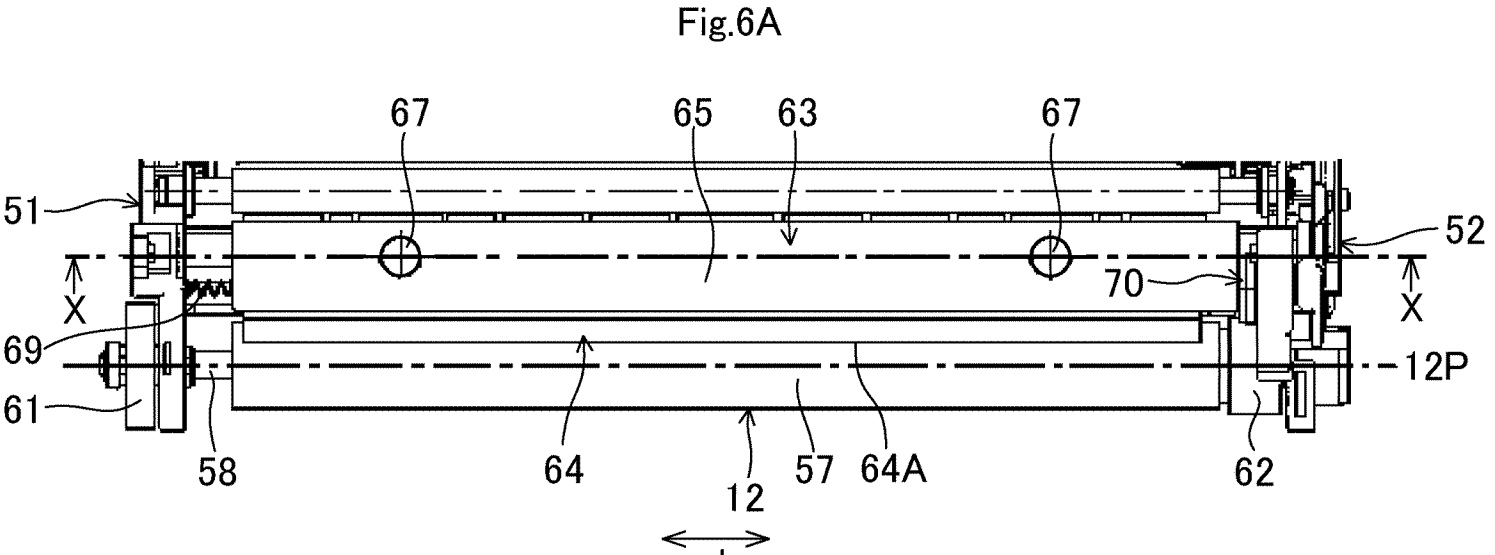
FIG. 6A is a plan view of a cleaning device.
Figure 6B:
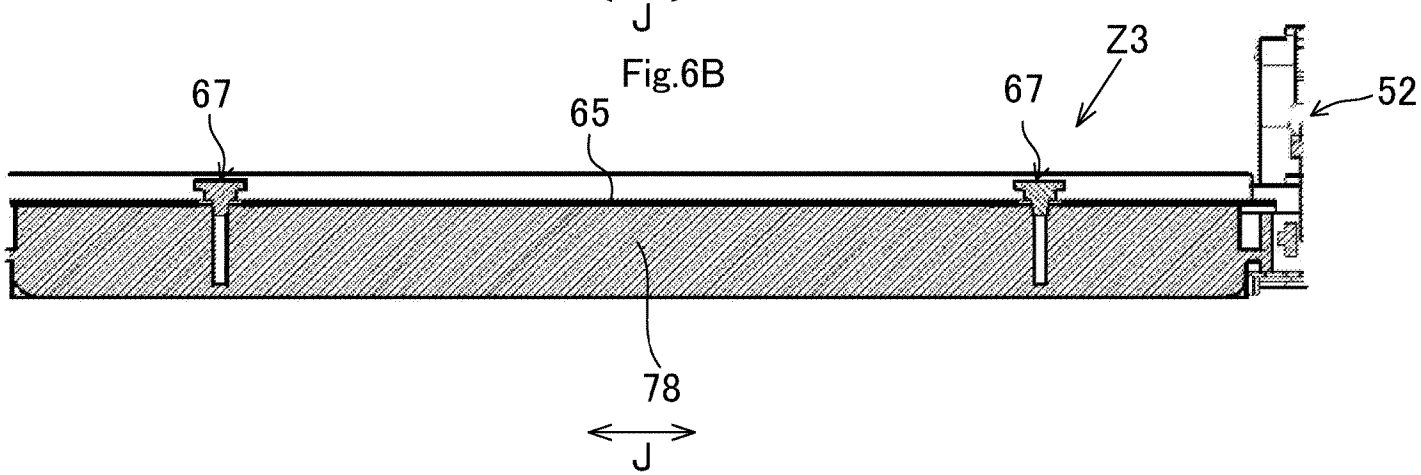
FIG. 6B is a sectional view taken along line X-X of FIG. 6A.

As illustrated in FIG. 6A, the scraper 64 is formed in a rectangular band plate shape slightly shorter than the roller body 57. The scraper holding plate 65 is wider and longer than the scraper 64 and is formed in a rectangular shape having approximately the same length as that of the roller body 57.

One end part (one end part opposite to the roller body 57) of a long side of the scraper 64 is superposed on one end part of a long side of the scraper holding plate 65 and is fixed by a double sided tape. In this way, a distal end part 64A of the scraper 64, which is the other end part of the long side of the scraper 64, protrudes toward the roller body 57 from one end side of the long side of the scraper holding plate 65.

Figure 9:
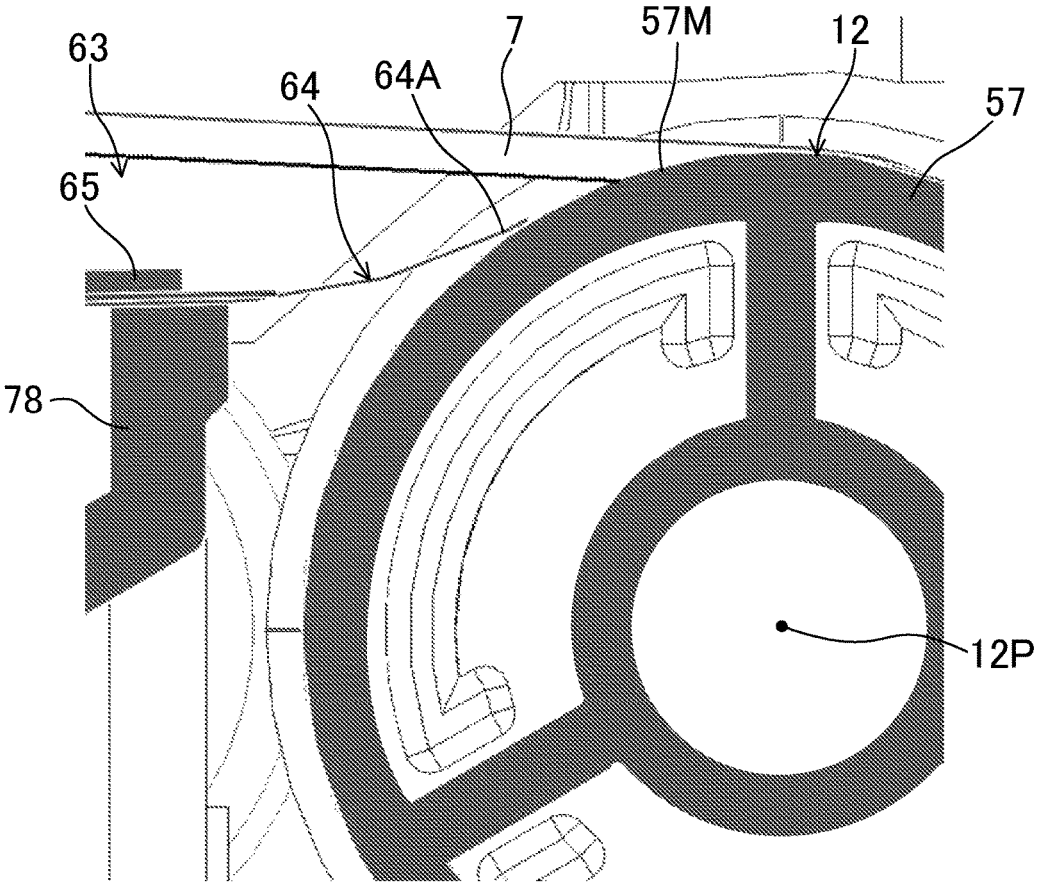
FIG. 9 is a longitudinal sectional side view of a cleaning device.

As illustrated in FIG. 6A and FIG. 9, the distal end part 64A of the scraper 64 abuts the peripheral surface 57M of the roller body 57 from a rotation direction downstream side of an upper belt part of the intermediate transfer belt 7. Furthermore, the distal end part 64A abuts the peripheral surface 57M of the roller body 57 over the full length of the roller body 57 in the roller shaft center direction J. The scraper 64 has a flexibility and is slightly elastically deformed upward in an arc shape in the state in which the distal end part 64A abuts the peripheral surface 57M of the roller body 57 (see FIG. 9).

[Structure of Reciprocating Mechanism 66]

Figure 3:
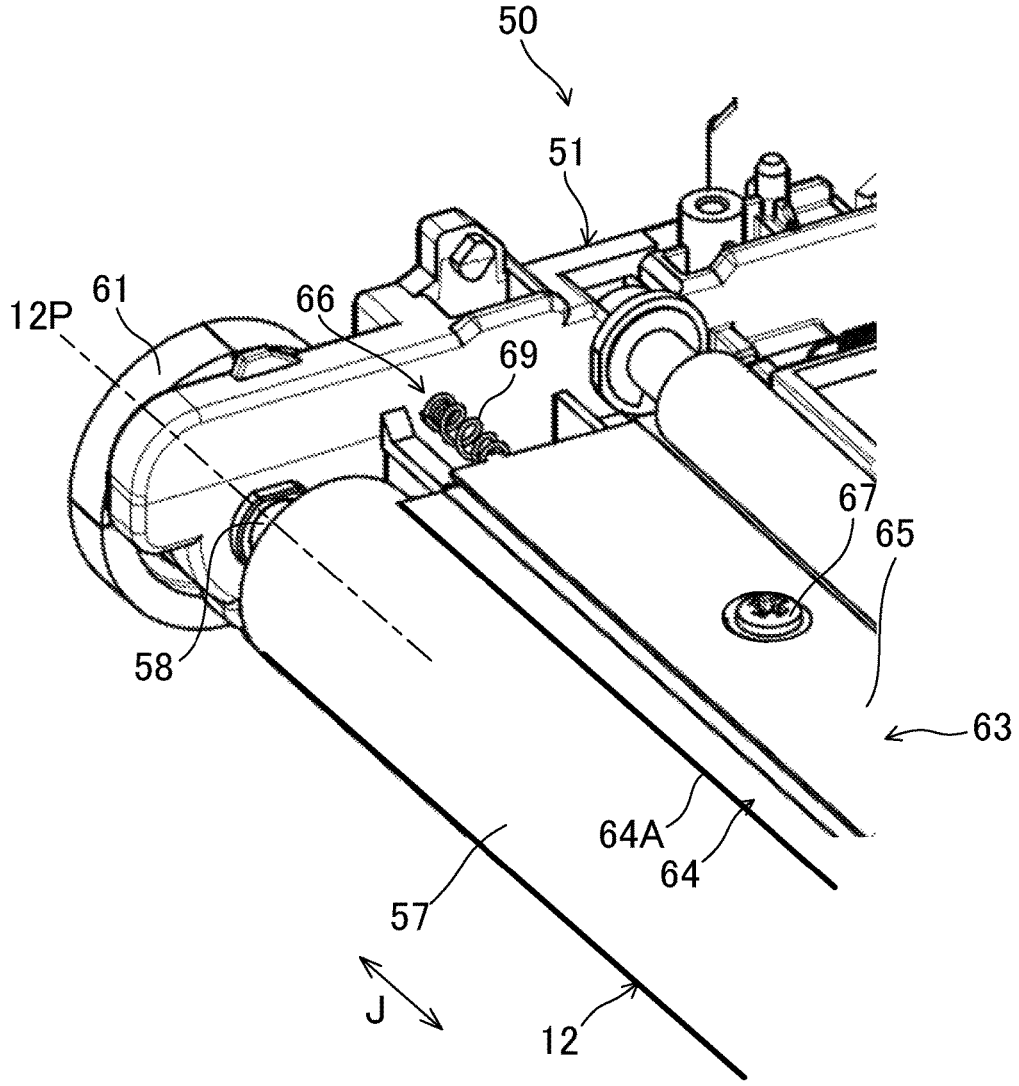
FIG. 3 is an enlarged perspective view of a Z1 part of FIG. 2.
Figure 5:
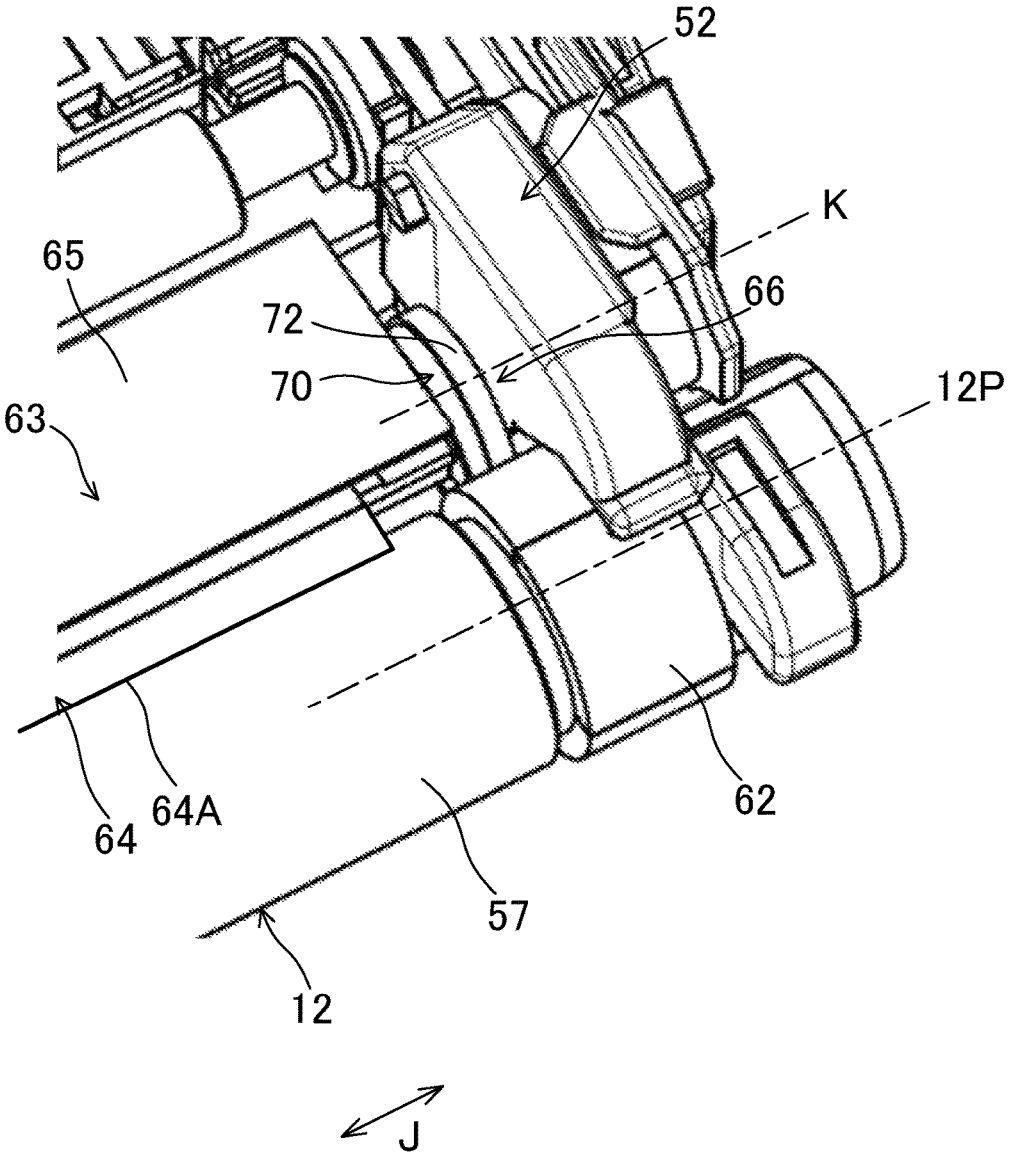
FIG. 5 is an enlarged perspective view of a Z2 part of FIG. 4.
Figure 7:
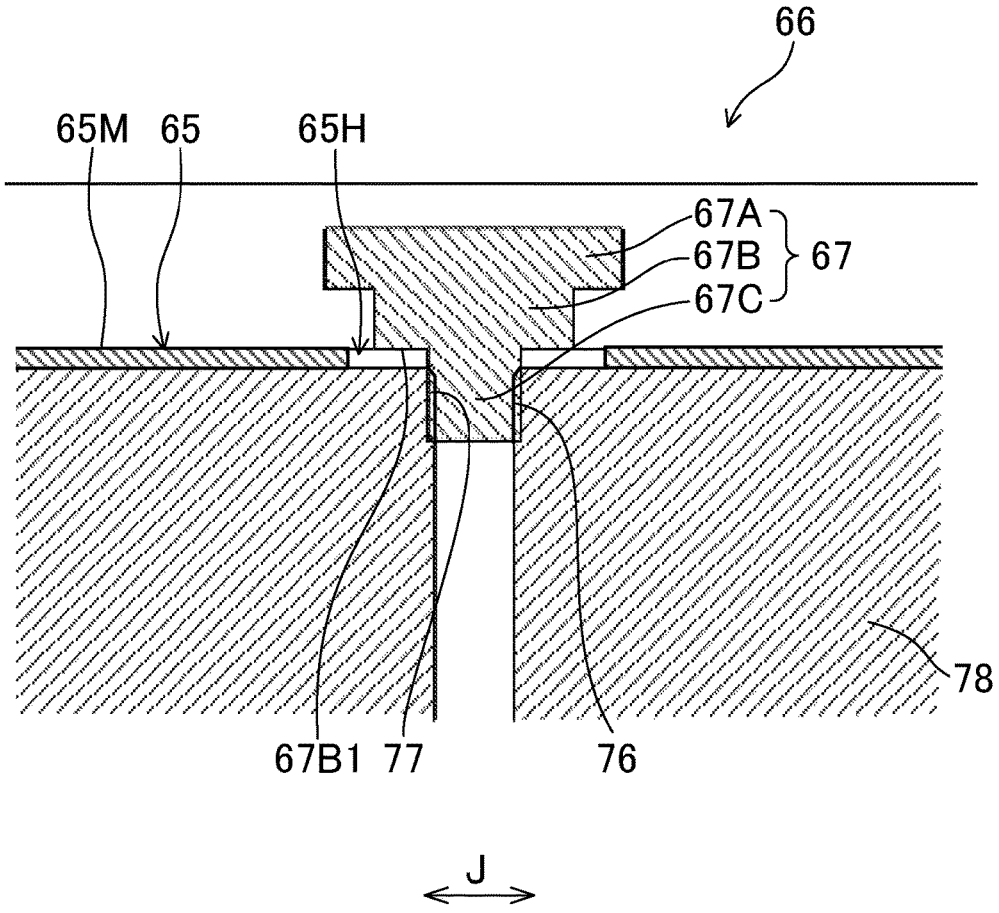
FIG. 7 is an enlarged view of a Z3 part of FIG. 6B.
Figure 8:
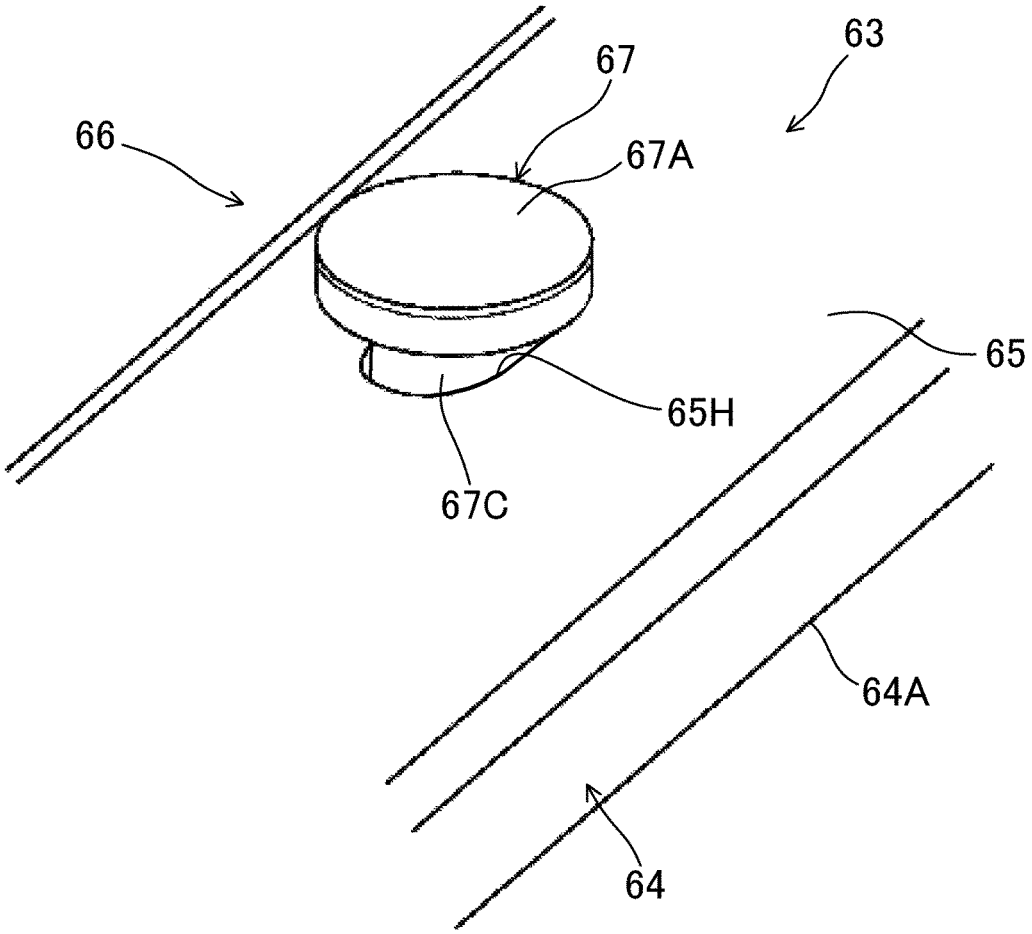
FIG. 8 is an enlarged view of a Z4 part of FIG. 4.

As illustrated in FIG. 3 and FIG. 5, the reciprocating mechanism 66 is provided to allow the scraper 64 to reciprocally move in the roller shaft center direction J of the driving roller 12 integrally with the scraper holding plate 65. Specifically, as illustrated in FIG. 7 and FIG. 8, a plurality of long holes 65H, which are long in the longitudinal direction (the roller shaft center direction J) of the scraper holding plate 65, are formed in the scraper holding plate 65 while being spaced apart from one another in the longitudinal direction.

Furthermore, a plurality of header pins 67 are individually inserted into the plurality of long holes 65H from above, and a male screw part 76 formed in a pin tip part 67C is screwed with a female screw part 77 formed in the connection wall 78 of the device frame 50. A longitudinal direction intermediate part 67B of the header pin 67 is formed to have a diameter larger than that of the pin tip part 67C. That is, the header pin 67 includes a head part 67A, the longitudinal direction intermediate part 67B having a diameter smaller than that of the head part 67A, and the pin tip part 67C having a diameter smaller than that of the longitudinal direction intermediate part 67B.

In a state in which the male screw part 76 has been screwed with the female screw part 77, a lower end surface 67B1 of the longitudinal direction intermediate part 67B of the header pin 67 is positioned above an upper surface 65M of the scraper holding plate 65. Furthermore, the diameter of the longitudinal direction intermediate part 67B is set to be larger than a width of the long hole 65H, so that the scraper holding plate 65 freely moves in the roller shaft center direction J with respect to the connection wall 78 and floating is not possible.

As illustrated in FIG. 3 and FIG. 6A, a coil spring 69 is provided between one end part of the scraper holding plate 65 in the longitudinal direction and the first sidewall 51 of the device frame 50 to press and urge the scraper holding plate 65 to the second sidewall 52 side. On the other hand, as illustrated in FIG. 5, a cam 70 is provided between the other end part of the scraper holding plate 65 and the second sidewall 52 of the device frame 50 to press the scraper holding plate 65 to the first sidewall 51 side against urging force of the coil spring 69.

Figure 10:
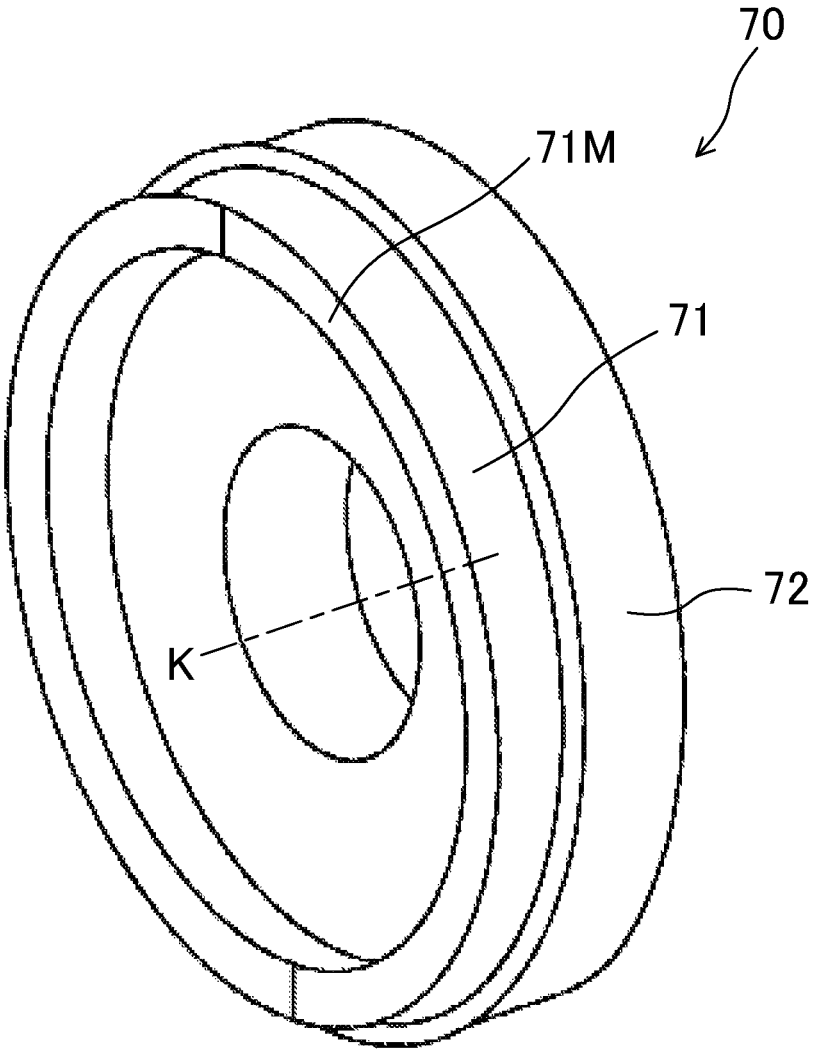
FIG. 10 is a perspective view illustrating a cam of a reciprocating mechanism of a cleaning device.

As illustrated in FIG. 10, the cam 70 includes a cam surface 71M inclined on an end surface of a cam body 71, which is formed in a circular ring plate shape, with respect to a cam shaft center K. Furthermore, as illustrated in FIG. 5, the cam 70 is supported to the second sidewall 52 around the cam shaft center K so as to freely rotate such that the cam shaft center K follows the roller shaft center direction J, so that the cam surface 71M abuts an end surface of the other end part of the scraper holding plate 65.

Furthermore, a third gear 72 is formed on an outer peripheral part of the cam body 71 and is engaged with the second gear 62. In this way, when the driving roller 12 is driven and rotated, the cam 70 is rotated around the cam shaft center K via the second gear 62 of the driving roller 12 side and the third gear 72 of the cam 70 side. With this rotation, the scraper holding plate 65 moves to the first sidewall 51 side against the urging force of the coil spring 69 or moves to the second sidewall 52 side by the urging force, so that the scraper 64 reciprocally moves in the roller shaft center direction J integrally with the scraper holding plate 65. As described above, the cam 70 of the reciprocating mechanism 66 is connected to the driving roller 12 in an interlocking manner such that the scraper 64 reciprocally moves in the roller shaft center direction J integrally with the scraper holding plate 65 with the rotation of the driving roller 12.

The header pin 67 guides an inner surface of the long hole 65H of the scraper holding plate 65 to the roller shaft center direction J when the scraper 64 reciprocally moves in the roller shaft center direction J integrally with the scraper holding plate 65. In this way, it is possible to allow the scraper 64 and the scraper holding plate 65 to accurately reciprocally move in the roller shaft center direction J.

According to the aforementioned configuration, even though toner is attached to the peripheral surface 57M of the driving roller 12 around which the intermediate transfer belt 7 is wound, the scraper 64 of the cleaning device 63 removes the toner from the peripheral surface 57M of the driving roller 12. Accordingly, it is possible to prevent aggregation of the toner on the peripheral surface 57M of the driving roller 12, thereby preventing a projection-like foreign matter including the toner from being formed on the peripheral surface 57M. As a consequence, it is possible to avoid damage of the inner surface of the intermediate transfer belt 7, so that it is possible to keep an image in a good state and thus to improve durability of the intermediate transfer belt 7.

Furthermore, the scraper 64 of the cleaning device 63 reciprocally moves in the roller shaft center direction J, so that toner attached to the peripheral surface 57M of the driving roller 12 is stretched in the roller shaft center direction J. In this way, aggregation of the toner rarely occurs on the peripheral surface 57M of the driving roller 12, so that it is possible to improve cleaning performance.

In addition, since the cam 70 of the reciprocating mechanism 66 is connected to the driving roller 12 in an interlocking manner, it is not necessary to newly provide a driving part for driving the reciprocating mechanism 66, so that it is possible to reduce the number of parts, to simplify a structure, and thus reduce manufacturing cost.

Moreover, since a roller to which the reciprocating mechanism 66 is connected in an interlocking manner, is the driving roller 12, it is possible to sufficiently transmit reciprocating force to the reciprocating mechanism 66, so that it is possible to stabilize the operation of the reciprocating mechanism 66.

In general, in the image forming apparatus 1, a cleaning device is provided around the intermediate transfer belt 7 to clean the outer surface of the intermediate transfer belt 7. Therefore, in the vicinity of the cleaning device, density of floating toner easily increases. According to the configuration of the present embodiment, even though toner is attached to the peripheral surface 57M of the driving roller 12, since the scraper 64 of the cleaning device 63 removes the toner, it is possible to dispose the cleaning device in the vicinity of the driving roller 12, so that it is possible to improve freedom in design. Also in the present embodiment, as described above, at the left upper part of the driving roller 12, the intermediate transfer belt cleaning device 34 is disposed to clean the surface (the outer surface) of the intermediate transfer belt 7.

<<Other Embodiments>>

The image forming apparatus 1 may be a copy machine, a facsimile and the like. The reciprocating mechanism 66 may be configured with parts other than the coil spring 69 and the cam 70.

What is claimed is:

1. An intermediate transfer unit comprising:

an endless intermediate transfer belt to which a toner image is primarily transferred from an image carrying member;

a driving roller that rotates the endless intermediate transfer belt;

a cleaning device which cleans a peripheral surface of the driving roller around which the endless intermediate transfer belt is wound;

a reciprocating mechanism that allows a cleaning unit of the cleaning device to reciprocally move in a shaft center direction of the driving roller;

a device frame which supports the driving roller and the endless intermediate transfer belt; and a header pin fixed to the device frame, wherein the toner image primarily transferred to the endless intermediate transfer belt is positioned at a secondary transfer position of a sheet material by rotational driving of the driving roller, the reciprocating mechanism is connected to the driving roller in an interlocking manner such that the cleaning unit reciprocally moves in the shaft center direction of the driving roller with rotation of the driving roller, the cleaning unit has a scraper abutting the peripheral surface of the driving roller, and a scraper holding plate which holds the scraper, the scraper holding plate is formed with a long hole extending in the shaft center direction of the driving roller, and the header pin is configured to guide along an inner surface of the long hole of the scraper holding plate in the shaft center direction when the scraper reciprocally moves in the shaft center direction integrally with the scraper holding plate.

2. An image forming apparatus comprising:

the intermediate transfer unit of claim 1, wherein the toner image formed on the image carrying member is transferred to a sheet material via the intermediate transfer unit.

3. The intermediate transfer unit of claim 1, wherein the device frame is provided with a first sidewall and a second sidewall arranged horizontally and spaced apart from each other in a predetermined direction, and is further provided with a connection wall that connects the first sidewall and the second sidewall to each other, at one end part of the first sidewall and one end part of the second sidewall in the predetermined direction, the driving roller is supported so as to freely rotate, and at another end part of the first side wall and the second sidewall, a driven roller is supported so as to freely rotate, the endless intermediate transfer belt is wound around the driving roller and the driven roller, the connection wall is adjacent to the driving roller and positioned at another side of the driving roller, and the scraper holding plate is connected to an upper surface of the connection wall via the header pin such that floating is not possible.

4. The intermediate transfer unit of claim 3, wherein the cleaning device includes a cam having a cam surface that abuts one end part in the shaft center direction of the driving roller in the scraper holding plate, and an urging material that urges the scraper holding plate to one side from another side in the shaft center direction of the driving roller, and the cleaning device is configured such that the cam rotates in an interlocking manner with rotation of the driving roller.

* * * * *